US005193892A

United States Patent [19]

Swindell

[11] Patent Number: 5,193,892

[45] Date of Patent: Mar. 16, 1993

[54] FOOD COMPARTMENT FOR REFRIGERATORS

[75] Inventor: Thomas R. Swindell, Sheridan, Mich.

[73] Assignee: White Consolidated Industries, Inc., Cleveland, Ohio

[21] Appl. No.: 695,938

[22] Filed: May 6, 1991

[51] Int. Cl.[5] ..... F25D 11/00

[52] U.S. Cl. ..... 312/405.1; 312/274

[58] Field of Search ..... 312/404, 405.1, 270.3, 312/274

[56] References Cited

U.S. PATENT DOCUMENTS

| | | | |
|---|---|---|---|
| 740,098 | 9/1903 | Davis | 312/274 |
| 2,667,758 | 4/1951 | Tenney et al. . | |
| 2,944,410 | 10/1955 | Mann et al. . | |
| 4,747,245 | 5/1988 | Lemeister et al. . | |
| 4,779,939 | 10/1988 | Stich . | |
| 4,798,425 | 1/1989 | Armstrong et al. . | |
| 4,801,182 | 1/1989 | Metcalfe et al. . | |
| 4,859,010 | 8/1989 | Jeziorowski . | |

FOREIGN PATENT DOCUMENTS

| | | | |
|---|---|---|---|
| 0144883 | 6/1951 | Netherlands | 312/274 |

*Primary Examiner*—Kenneth J. Dorner
*Assistant Examiner*—Gerald A. Anderson
*Attorney, Agent, or Firm*—Pearne, Gordon, McCoy & Granger

[57] ABSTRACT

A food storage compartment for refrigerators includes a housing, a food support tray, and a cover pivoted on the housing. The tray is movable from a storage position to an access position. The cover and housing cooperate to enclose the tray and any food stored thereon when the tray is in the storage position. Cam means are provided to automatically open the cover when the tray is moved to an access position. Return of the tray to the storage position or return of the cover to its closed position automatically returns the tray and cover to the storage condition.

10 Claims, 4 Drawing Sheets

FOOD COMPARTMENT FOR REFRIGERATORS

BACKGROUND OF THE INVENTION

This invention relates generally to the storage of food products, and more particularly to a novel and improved food storage compartment structure for refrigerators.

PRIOR ART

Domestic refrigerators often provide storage trays or compartments on the refrigerator door to support various types of food products. Examples of such systems are illustrated in U.S. Pat. Nos. 2,667,758; 2,944,410; 4,747,245; 4,779,939; 4,798,425; 4,801,182; and 4,859,010. Some such letters patent illustrate food storage compartments having covers movable from a closed position in which the compartment is isolated from the remainder of the refrigerated space and an open position in which the stored food within the compartment is accessible. Examples of such storage compartments are illustrated in U.S. Pat. Nos. 2,944,410; 4,798,425; and 4,801,182, also listed, supra.

Such food storage trays and containers are sometimes removable for cleaning and/or transporting the food products to another location.

SUMMARY OF THE INVENTION

The present invention provides a novel and improved food storage container assembly for refrigerators. Such container assembly provides a housing, a cover or compartment door pivoted on the housing, and a storage tray in which the food products are supported.

The tray is movable relative to the housing between a storage position within the housing per se and an extended or access position providing easy access to the food stored thereon is provided. The cover and tray are interconnected so that movement of the tray to the access position automatically causes the cover to open. Further, when the tray is returned to its storage position, the cover automatically closes. If desired, closing of the cover while the tray is in the access position automatically moves the tray to the storage position. Further, the tray can be removed for cleaning or for transporting the foodstuffs stored thereon to other locations.

In the illustrated embodiment, all of these several functions are provided by interengaging cam surfaces integrally provided on the tray and cover. Therefore, the entire container assembly only requires three parts, which can be economically produced from injection-molded plastic. Further, the illustrated embodiment is structured so that the entire assembly can be mounted at various locations on a compatible refrigerator door. Still further, if desired, more than one container assembly can be mounted on a given refrigerator door.

These and other aspects of the invention are illustrated in the accompanying drawings, and are more fully described in the following specification.

DETAILED DESCRIPTION OF THE INVENTION

Figure 1:
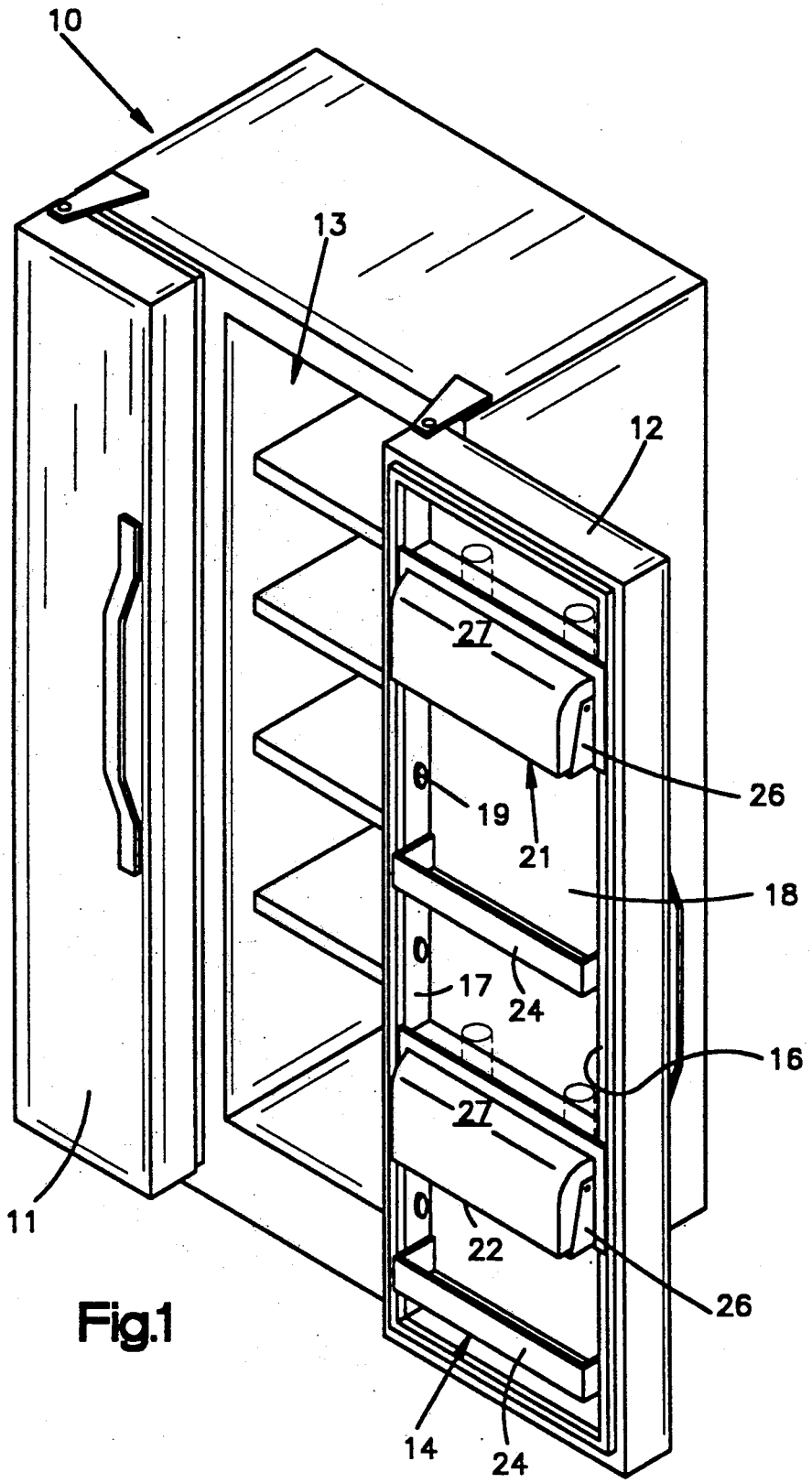
FIG. 1 is a perspective view of a typical refrigerator having food storage compartments or bins in accordance with the present invention mounted on the door thereof.

FIG. 1 illustrates a typical side-by-side refrigerator 10 providing two doors 11 and 12. The door 11 functions to close or provide access to the freezer compartment of the refrigerator and the door 12 operates to close or provide access to the refrigeration or non-freezing compartment 13 in which food is stored in a refrigerated but unfrozen state. The door 12 is provided with an inner liner 14 having opposed, vertical, forward projections 16 and 17 which cooperate to define a recessed zone 18 therebetween. Each of the projections is provided with a series of vertically spaced mounting lugs 19 along their inner surfaces for mounting of storage units of various types.

In FIG. 1, two food storage bins or containers 21 and 22 are mounted on the lugs 19, with an upper storage container 21 positioned substantially adjacent to the upper end of the door and a lower storage container 22 located near the bottom of the door. Also illustrated in FIG. 1 are open trays 23 and 24 which are also mounted on the mounting lugs 19. As illustrated in FIG. 1, the upper side of the storage container also functions as an open tray.

The positioning of the storage containers 21 and 22 and the open trays 23 and 24 is illustrated as representative of one arrangement that can be provided, depending upon the user's preference. The two storage containers 21 and 22 are constructed in accordance with the present invention, and are identical in structure. It should be understood that the trays and storage containers can be installed at any desired location where lugs 19 exist to permit the mounting thereof.

Figure 3:
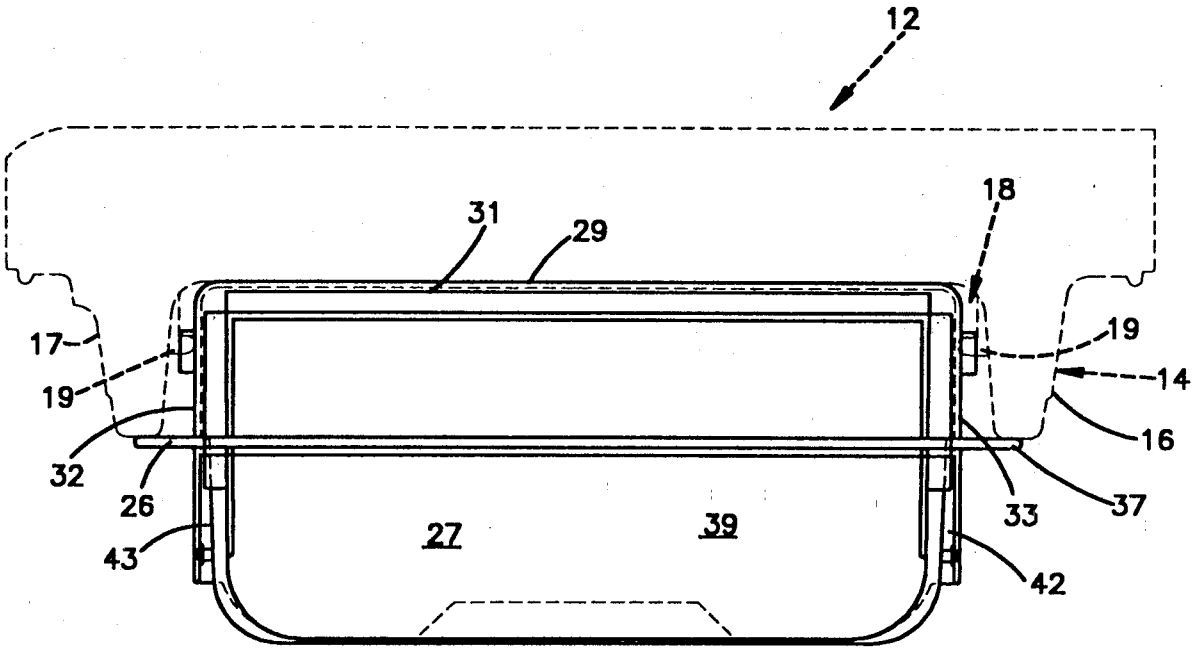
FIG. 3 is a plan view, taken generally along line 3—3 of FIG. 2.

In the illustrated embodiment of the present invention, the storage containers 21 and 22 are each formed of an assembly including three parts, each of which is preferably an injection-molded part. The three parts are the housing 26, a cover 27, and a food storage tray 28. The housing 26 is sized to fit between the two projections 16 and 17 and into the recess 18, as best illustrated in FIG. 3, and is generally rectangular in shape. The housing provides a rear wall 29 which fits against the back wall 31 of the recessed zone 18 and forwardly extending sidewalls 32 and 33. The housing also provides a top wall 34 and a bottom wall 36. These various walls cooperate to define a forwardly open chamber in which the tray 28 is received. The housing is also provided with a flange 37 which extends around the two sidewalls and the top wall, and fits against the forward extremity of the two projections 16 and 17.

Figure 2:
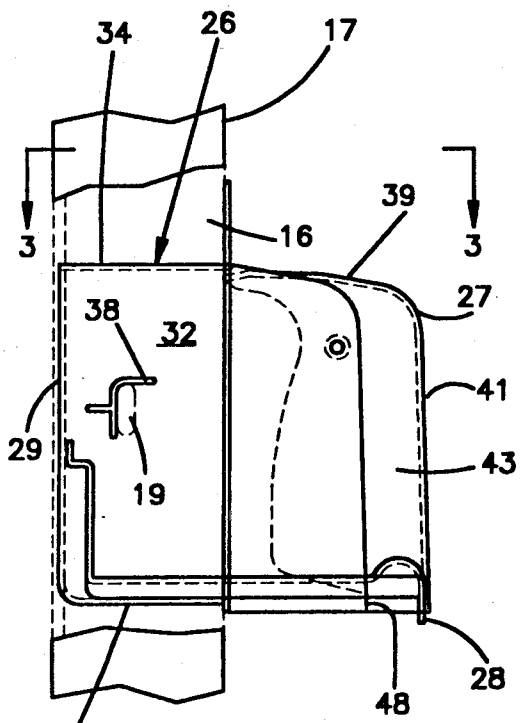
FIG. 2 is an enlarged side elevation illustrating one of the food storage bins mounted on the door.

The housing provides opposed and similar L-shaped mounting projections 38, which engage the adjacent mounting lugs 19 along the top and back sides thereof, as best illustrated in FIG. 2, to securely mount the entire storage container assembly on the door 12. Installation is accomplished by positioning the housing of the assembly within the recess, and lowering it until the L-shaped mounting projection engages the back and top sides of the associated mounting lug 19. Removal is accomplished by merely raising the housing. With this simple structure, the entire assembly can be mounted in any one of a plurality of positions on the door.

Figure 4:
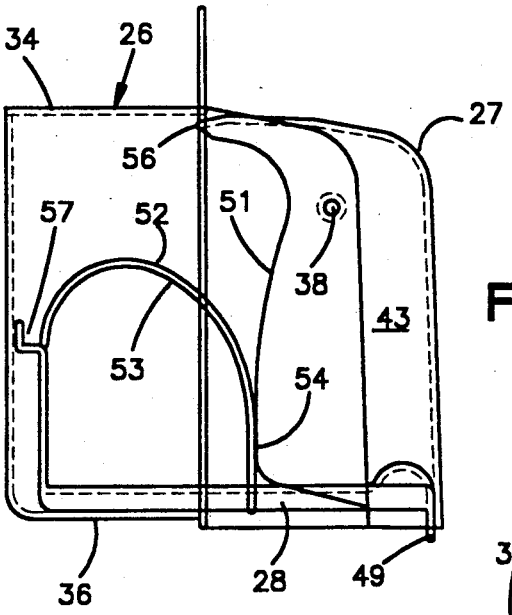
FIG. 4 is a side elevation, with parts broken away to illustrate the cam system with the components in the closed position.
Figure 4A:
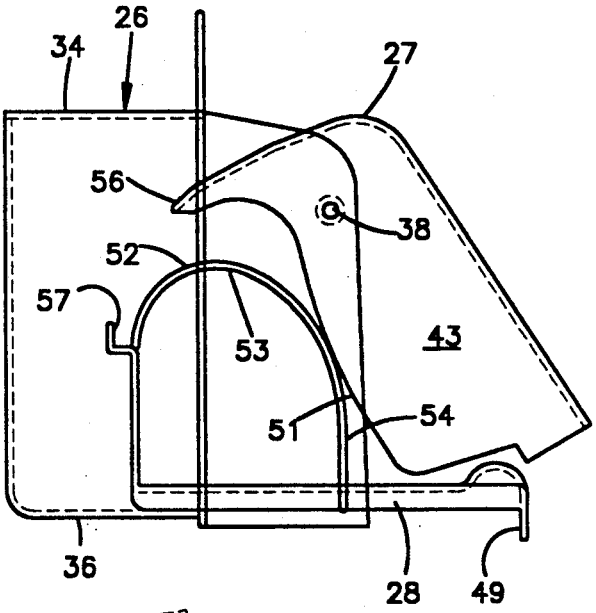
FIG. 4*a* is a view similar to FIG. 4, but illustrating the tray and cover in an intermediate position between the storage position and the access position.
Figure 4B:
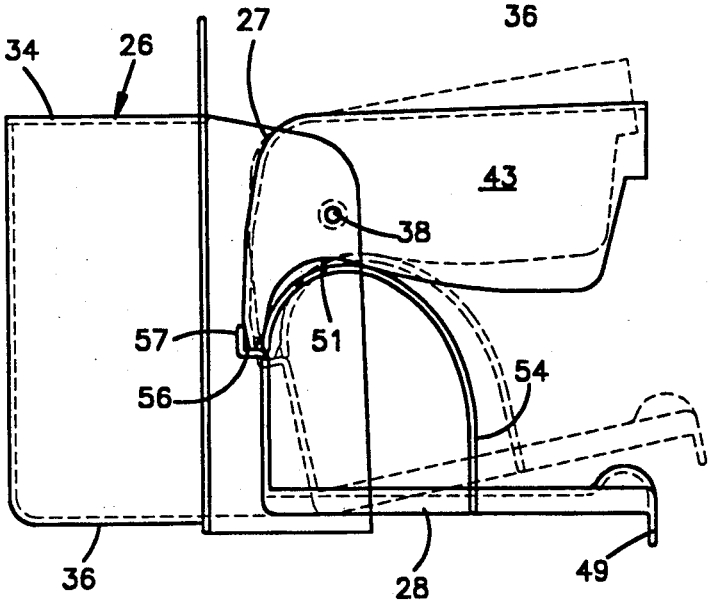
FIG. 4*b* is a view similar to FIGS. 4 and 4*a*, but illustrating the tray and cover in the access position of the tray, and illustrating the manner of removal of the tray in phantom.
Figure 5:
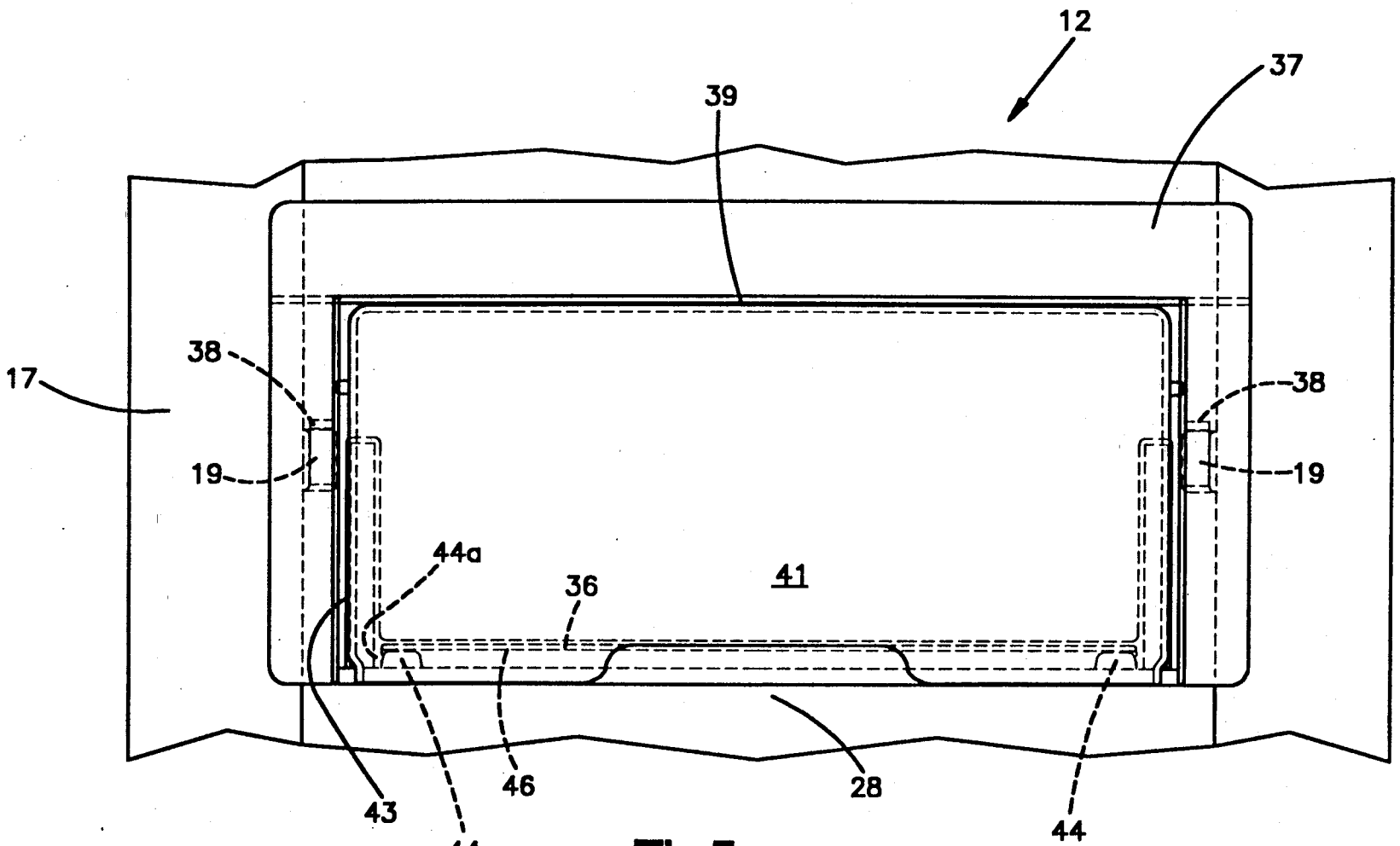
FIG. 5 is a front elevation with the cover open, illustrating the tray support structure.

The cover 27 is connected to the housing by a pivot 38 for movement between a closed position, illustrated in FIGS. 1 through 3, and an open position, illustrated in FIGS. 4*b* and 5. The cover includes a top wall 39 which extends forwardly from the top wall of the housing 34 when the cover is in the closed position and cooperates therewith to enclose the top of the compartment. The cover also provides a front wall 41 which extends from the top wall 39 down to a position in alignment with the tray 28 when in the closed position. The cover also provides opposed sidewalls 42 and 43, so that the housing and cover cooperate to enclose the tray when the cover is in the closed position.

As best illustrated in FIG. 5, the bottom wall 36 of the housing is provided with two upstanding rail-like portions 44 on which the tray rests and is supported during its movement between the forward access position and the rearward storage position. These rails engage the bottom wall 46 of the tray and provide a relatively small area of contact between the bottom wall of the tray and the housing so that substantial friction does not exist when the tray is moved back and forth. The bottom wall of the tray is provided with depending flanges 44*a* along each lateral edge which fit down along the outer side of the associated rail 44 to laterally position and guide the tray in its movement between the access position and the storage or rearward position thereof.

The bottom wall 36 of the housing extends forwardly to its forward edge 48 spaced rearwardly of the front wall 41 of the cover when the cover is in the closed position, and spaced rearwardly from a forward skirt 49 in the tray so that the user can insert fingers between the housing and the skirt to pull the tray to the forward and access position when such access is desired.

The cover 27 and the food storage tray 28 are provided with mating camming surfaces which function when the tray is pulled forward to the access position to automatically open the cover, as best illustrated in FIGS. 4*a* and 4*b*. The camming surfaces 51 of the cover are generally "S" shaped and are provided along the rearward edge of both of the sidewalls 42 and 43 of the cover. The camming surfaces 52 of the tray are provided by a laterally extending flange 53 formed along each side of the tray in alignment with the camming surface 51. The camming surfaces 52 extend upwardly from the base of the tray to a pocket 57 and have a shape generally like a portion of a spiral in that they extend with gradually decreasing radius. The two camming surfaces 51 and 52 interengage along a lower, substantially vertical portion 54 when the cover is in the closed position and the tray is in the storage position.

As the tray is pulled forward toward the access position, such engagement causes the cover 27 to commence to pivot around the pivot 38 toward an open position, as illustrated in FIG. 4*a*. Continued movement of the tray to the access position illustrated in full line in FIG. 4*b* causes the cover to move to its fully open position illustrated in FIG. 4*b*, in which access is provided to any foodstuffs supported on the tray.

During such movement, the point of engagement between the associated camming surfaces 51 and 52 moves upwardly along the two camming surfaces until the open position is reached, in which the camming surface 51 extends over the top of the camming surface 52 and the engagement therebetween extends substantially horizontally. As such movement occurs, a nose 56 or blocking surface formed at the rearward end of the top wall 39 of the cover moves to a position within the pocket 57 formed in the back wall of the tray to prevent continued movement of the tray out of the housing beyond the access position of FIG. 4*b*. Such engagement between the nose 56 and the pocket 57 also holds the rearward edge of the tray down against the rails 44 to prevent the weight of the foodstuffs stored on the tray from causing its front edge to tip down. Thus, this structure involving the nose 56 and the pocket functions to limit extension of the tray during normal use and cooperates with the rails to hold the tray in a horizontal position.

When it is desired to remove the tray from the assembly, the front edge of the tray is lifted, as illustrated in phantom, to move the pocket down away from the nose, as illustrated in FIG. 4*b*. This causes the point of engagement between the two camming surfaces to raise the cover, as illustrated in phantom in FIG. 4*b*, and allows the tray to be moved forwardly out of the housing to complete the separation thereof. The tray can be removed for cleaning or for transporting foodstuffs supported thereon to any location. Reinstallation of the tray is easily accomplished by raising the cover and sliding the tray back along the rails in a raised position until the nose 56 is repositioned within the pocket 57, and then lowering the front edge of the tray back to the access position.

After the tray is positioned in the access position, the cover and tray can be returned to the storage position in either of two ways. If the tray is pushed back into the housing, the engagement between the nose 56 and the pocket 57 automatically commences pivotal movement of the cover down toward its normal closed position, and as the movement is continued, the weight of the cover maintains the engagement between the two camming surfaces 51 and 52 until the tray is fully back in its storage position and the cover is fully closed. Alternatively, the tray can be moved from the access position to the storage position by merely closing the cover. As the cover commences to close, the engagement of the nose 56 within the pocket 57 slides the tray back towards the storage position until a point is reached in the engagement between the two camming surfaces in which they function to continue the movement of the tray to its storage position when the cover is closed.

With this invention, a simple camming system is provided to automatically open the cover as the tray is pulled forward to the access position. Return of the tray to the storage position and return of the cover to its closed position are easily accomplished by either pushing the tray back into the housing or pushing the cover toward its closed position. Further, a simple structure is provided in which foodstuffs supported on the tray are completely enclosed in the storage position but are easily accessible in the access position. Still further, by providing a separate assembly for the food storage container, it is possible to locate such container at substantially any location desired on the door of the refrigerator and to provide more than one food storage container if desired.

Although the preferred embodiment of this invention has been shown and described, it should be understood that various modifications and rearrangements of the parts may be resorted to without departing from the scope of the invention as disclosed and claimed herein.

What is claimed:

1. A refrigerator food storage compartment mounted on a refrigerator door, said compartment comprising a housing, a support tray, and a compartment cover, said housing being mounted on said door, said cover being pivotally mounted on said housing for movement between a closed position and an open position, said tray being operable to support food stuff and being moveable relative to said housing between a storage position and an access position, said housing and cover cooperating to define a compartment for enclosing food stuff on said tray when said tray is in said storage position, and cam means for opening said cover in response to movement of said tray from said storage position to said access position, said cam means operating to move said tray from said access position to said storage position when said cover is moved to said closed position.

2. A food storage compartment as set forth in claim 1, wherein said cam means moving said cover to said closed position when said tray is moved to said storage position.

3. A food storage compartment as set forth in claim 2, wherein said tray is removable from and installable in said assembly when said cover is open in said access position.

4. A food storage compartment as set forth in claim 3, wherein said cam means includes cooperating engageable camming surfaces formed on said tray and cover.

5. A refrigerator food storage system comprising a refrigerator cabinet, a storage assembly mounted on said door, and said assembly including:

(a) a molded plastic housing, (b) a molded plastic cover, and (c) a molded plastic tray for supporting refrigerated foodstuffs;

said housing providing a support surface supporting said tray for movement between a storage position and a forward access position, said cover being pivotally mounted on said housing for movement from a closed position in which said cover cooperates with said housing and tray to define a closed compartment for storage of refrigerated foodstuffs and an open position, and cam means on said cover and tray for opening said cover in response to movement of said tray from said storage position to said access position, said cover providing a blocking surface engageable with said tray cooperating with said support surface to hold said tray level when said tray is in said extended position.

6. A storage system as set forth in claim 5, wherein said cam means includes a vertically extending curved cam on said tray.

7. A storage system as set forth in claim 5, wherein said support surface is provided by a pair of upwardly projecting rails having sides, and said tray provides guide means for engaging at least two opposed of said sides to guide and laterally position said tray as it moves between said access and storage positions.

8. A storage system as set forth in claim 5, wherein said support surface of said housing extends to a forward end, and said blocking surface is located rearwardly of said forward end when said tray is in said access position.

9. A storage system as set forth in claim 5, wherein said tray is removable from said assembly from said access position by raising a forward edge of said tray.

10. A storage system as set forth in claim 5, wherein said blocking surface normally prevents movement of said tray beyond said access position in a direction away from said storage position.

* * * * *

UNITED STATES PATENT AND TRADEMARK OFFICE

CERTIFICATE OF CORRECTION

PATENT NO. : 5,193,892

DATED : March 16, 1993

INVENTOR(S) : Thomas R. Swindell

It is certified that error appears in the above-identified patent and that said Letters Patent is hereby corrected as shown below:

Column 5, Claim 5, line 36, after "cabinet," insert --a refrigerator door, and--; and Claim 5, line 37, delete "and".

Signed and Sealed this

Twenty-fifth Day of January, 1994

*Attest:*

Bruce Lehman

BRUCE LEHMAN

*Attesting Officer*

*Commissioner of Patents and Trademarks*